US012727633B2

(12) United States Patent
Mathew et al.

(10) Patent No.: US 12,727,633 B2
(45) Date of Patent: Sep. 8, 2026

(54) TEXTURED GLOVE AND A SYNTHETIC LATEX FORMULATION FOR PRODUCING THE SAME

(71) Applicant: YTY INDUSTRY SDN BHD, Kuala Lumpur (MY)

(72) Inventors: Monichan Puthuvelil Mathew, Kuala Lumpur (MY); Vikramjit Singh Hora, Kuala Lumpur (MY); Andrew Kells, Kuala Lumpur (MY)

(73) Assignee: YTY INDUSTRY SDN BHD, Kuala Lumpur (MY)

( * ) Notice: Subject to any disclaimer, the term of this patent is extended or adjusted under 35 U.S.C. 154(b) by 0 days.

(21) Appl. No.: 18/926,848

(22) Filed: Oct. 25, 2024

(65) Prior Publication Data

US 2025/0134194 A1 May 1, 2025

Related U.S. Application Data

(60) Provisional application No. 63/593,587, filed on Oct. 27, 2023.

(51) Int. Cl.
*A41D 19/015* (2006.01)
*A41D 19/00* (2006.01)
*A41D 19/04* (2006.01)

(52) U.S. Cl.
CPC ... *A41D 19/01547* (2013.01); *A41D 19/0082* (2013.01); *A41D 19/04* (2013.01); *A41D 2500/50* (2013.01)

(58) Field of Classification Search
CPC ..... A41D 19/01547; A41D 19/0082; A41D 19/0058; A41D 19/01558; A41D 19/0062; A41D 19/0055
See application file for complete search history.

(56) References Cited

U.S. PATENT DOCUMENTS 5,676,092 A * 10/1997 Ortolivo ..... A47L 13/18 119/650
10,993,488 B1 5/2021 Chou
(Continued)

FOREIGN PATENT DOCUMENTS

WO WO-2017053818 A1 * 3/2017 ..... A41D 19/015
WO 2021/006719 A1 1/2021

*Primary Examiner* — Haley A Smith
(74) *Attorney, Agent, or Firm* — MUNCY, GEISSLER, OLDS & LOWE, P.C.

(57) ABSTRACT

An elastomeric glove includes a superimposed texture provided on a surface of the elastomeric glove, including front and back of a palm region, a thumb region and fingers region. The superimposed texture includes multiple units of a stellate convex polygon distributed on the surface of the elastomeric glove, with a tip at the center and folded at intersects of the polygon for gripping, diverting and channelling fluid away from the surface of the elastomeric glove. The stellate convex polygon includes a plurality of outward-facing corner vertices and plurality of inward-facing vertices, with equal sides connecting each of the plurality of outward-facing corner vertices to adjacent inward-facing vertices. Each of the inward-facing vertices has an exterior angle of 138 to 146 degrees, and each of the outward-facing corner vertices has an interior angle of 46 to 52 degrees. A synthetic latex formulation for producing the elastomeric glove is also disclosed.

8 Claims, 7 Drawing Sheets

(56) References Cited

U.S. PATENT DOCUMENTS

| | | | | |
|---|---|---|---|---|
| 11,241,051 | B2 | 2/2022 | Furlong | |
| 2010/0257656 | A1* | 10/2010 | Hull | A41D 19/0003 2/163 |
| 2013/0025024 | A1* | 1/2013 | Hull | A41D 19/0003 2/163 |

* cited by examiner

TEXTURED GLOVE AND A SYNTHETIC LATEX FORMULATION FOR PRODUCING THE SAME

CROSS REFERENCE TO RELATED APPLICATIONS

This application claims priority of U.S. Provisional Application No. 63/593,587 filed on Oct. 27, 2023 under 35 U.S.C. § 119(e), the entire contents of all of which are hereby incorporated by reference.

FIELD OF THE INVENTION

The present invention relates generally to an elastomeric glove with a superimposed texture. More particularly, the present invention relates to a textured glove with stellate convex polygons and a synthetic latex formulation for producing the said textured glove.

BACKGROUND OF THE INVENTION

When elastomeric gloves are wet and/or in contact with various oils and fluids, the reduced surface friction between the glove's contacting surfaces and an object results in a less firm and weak grip. One of the ways to address this issue is to increase friction by adding texture to the grasp surfaces of the elastomeric glove. To date, there have been several textured gloves proposed to improve the grip. Some of these examples are discussed in the following prior arts.

WO2021006719A1 discloses a glove with enhanced grip in handling dry, wet and/or oily objects. The glove consisting superimposed texture on an outer surface of the glove, wherein the superimposed texture is microtexture overlaid on macropattern such as honeycomb, fish scale, zigzag, square, circle, wave, fan, star, et cetera.

U.S. Pat. No. 11,241,051B2 discloses an ambidextrous working glove having fish scale-textured inner and outer surfaces for providing advantageous grip properties. The textured inner surfaces of the glove include a series of islands surrounded by channels. The channels present on the inner surfaces facilitate the flow of sweat accumulated on the hands towards the glove's cuff area, potentially allowing it to drain towards the user gown/sleeve and over the object being handled. Furthermore, if the glove in use is facing downwards with the fingers facing in that direction, sweat would flow towards and accumulate at the fingertips, yielding user discomfort as well the glove film sliding over the fingers yielding deficiencies in manual dexterity and gripping.

U.S. Pat. No. 10,993,488B1 discloses a glove with gripping projections. The outer surface of the glove including a plurality of raised projections, wherein the base of each projection is a polyhedron with two parallel linear sides and two parallel curved sides. The projections allow a flow path for liquid to better escape from between the glove and an object being grasped.

The above-mentioned prior arts offer textured gloves with enhanced grip properties. Nevertheless, their texture patterns do not create continuous channels that allow fluid to be orderly diverted and channelled away from the outer surface of the glove in wet condition. The texture patterns of existing gloves such as honeycomb, fish scale, and diamond have only up to four sides. These patterns may have limited grip which can be further enhanced by the number of sides and contact surface area on the patterns for better friction and grip. Further, these patterns do not feature angles which can widened when a frictional force is applied. Moreover, the gloves in the prior art do not provide a synthetic latex formulation that can produce a soft and durable textured glove that can enhance the user's experience in terms of comfortability and dexterity during work operation. Furthermore, they do not provide the synthetic formulation that can synergize with the texture pattern of the glove to promote sweat absorption on the glove's inner surface. Accordingly, there is still a need in the art to optimize the texture pattern of the glove for enhancing grip, fluid diverting and channelling, as well as to provide a synthetic latex formulation for enhancing the flexibility and sweat absorption of the textured glove.

SUMMARY OF THE INVENTION

The following presents a simplified summary of the invention in order to provide a basic understanding of some aspects of the invention. This summary is not an extensive overview of the invention. Its sole purpose is to present some concepts of the invention in a simplified form as a prelude to the more detailed description that is presented later.

It is an objective of the present invention to provide a textured glove with stellate convex polygons having a unique geometry for enhancing grip in wet and dry conditions.

It is also an objective of the present invention to provide a textured glove with channels for diverting and channelling fluid away from the outer surface of the textured glove in wet conditions.

It is yet another objective of the present invention to provide a synthetic latex formulation that is capable of producing a soft and durable textured glove with enhanced flexibility, thereby improving user's experience in terms of comfort and dexterity.

It is further an objective of the present invention to provide a synthetic latex formulation that is capable of synergizing with the texture pattern of the glove to promote sweat absorption on the glove's inner surface.

It is another objective of the present invention to provide a synthetic latex formulation that can offer improved permeation resistance superior to other latex based gloves such as natural rubber gloves and meeting at least type B categorization as per EN 374-1 standard.

Accordingly, these objectives may be achieved by following the teachings of the present invention. The present invention discloses an elastomeric glove comprising a superimposed texture provided on a surface of the elastomeric glove, including front and back of a palm region, a thumb region and fingers region, characterized in that the superimposed texture comprises multiple units of a stellate convex polygon distributed on the surface of the elastomeric glove, with a tip at the center and folded at intersects of the polygon for gripping, diverting and channelling fluid away from the surface of the elastomeric glove, wherein the stellate convex polygon comprises a plurality of outward-facing corner vertices and plurality of inward-facing vertices, with equal sides connecting each of the plurality of outward-facing corner vertices to adjacent inward-facing vertices, wherein each of the plurality of inward-facing vertices has an exterior angle of 138 to 146 degrees, and each of the plurality of outward-facing corner vertices has an interior angle of 46 to 52 degrees.

According to an embodiment of the invention, a non-superimposed texture portion is provided on a region between the palm region and the thumb region.

According to an embodiment of the invention, the superimposed texture provided on the thumb region is divided into a left texture region and a right texture region, encompassing a front surface and a back surface of the elastomeric glove (10).

According to an embodiment of the invention, the elastomeric glove comprises channels which are formed between the multiple units of the stellate convex polygon.

According to an embodiment of the invention, the stellate convex polygon comprises a protruding textured pattern that corresponds to a depressed textured pattern on an inner surface of the elastomeric glove.

BRIEF DESCRIPTION OF THE ACCOMPANYING DRAWINGS

The manner in which the above recited features of the present invention can be understood in detail, a more particular description of the invention, briefly summarized above, may have been referred by embodiments, some of which are illustrated in the appended drawings. It is to be noted, however, that the appended drawing illustrates only typical embodiments of this invention and is therefore not to be considered limiting of its scope, for the invention may admit to other equally effective embodiments.

The features, benefits, and advantages of the present invention will become apparent by reference to the following text figure, with like reference numbers referring to like structures across the views, wherein.

DETAILED DESCRIPTION OF THE INVENTION

Figure 1:
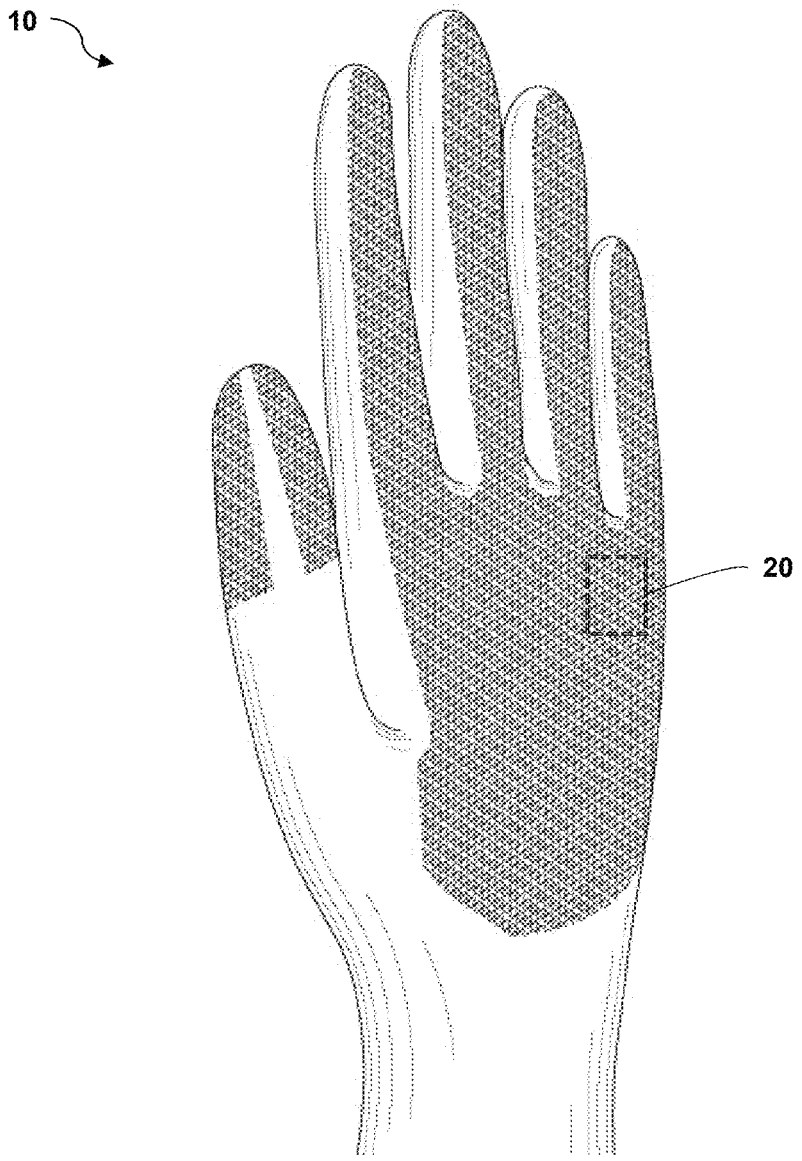
FIG. 1 is an isometric view of a textured glove in accordance with an embodiment of the present invention.

The present invention is described herein by way of example using embodiments and illustrative drawings. It should be understood that the drawings and detailed description thereto are not intended to limit the invention to the particular form disclosed, but on the contrary, the invention is to cover all modifications, equivalents, and alternatives falling within the scope of the present invention as defined by the appended claim. As used throughout this description, the words "a" or "an" mean "at least one". Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, materials, articles and the like is included in the specification solely for the purpose of providing a context for the present invention. It is not suggested or represented that any or all of these matters form part of the prior art base or were common general knowledge in the field relevant to the present invention.

In this disclosure, whenever a composition or an element or a group of elements is preceded with the transitional phrase "comprising", it is understood that we also contemplate the same composition.

The present invention is described hereinafter by various embodiments so that this disclosure will completely and fully convey the scope of the invention to those skilled in the art. Furthermore, numeric values and ranges are provided for various aspects of the implementations described. These values and ranges are to be treated as examples only, and are not intended to limit the scope of the claims. In addition, a number of materials are identified as suitable for various facets of the implementations and are not intended to limit the scope of the invention.

The present invention proposes a texture pattern for an elastomeric glove (10) that enhances grip in wet and dry conditions, diverts and channels fluid away from an outer surface of the elastomeric glove (10) in wet conditions.

Referring to the drawings as shown in FIGS. 1 to 10, the invention will now be described in more detail.

Figure 2:
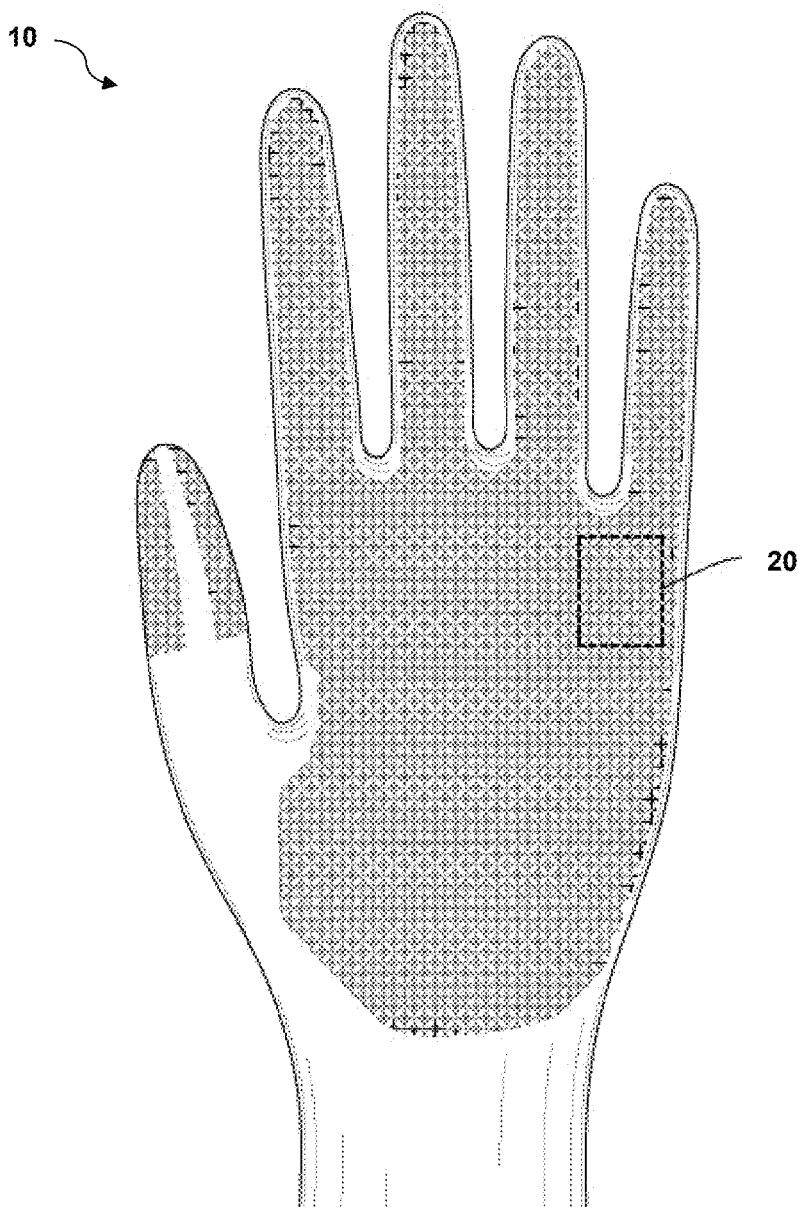
FIG. 2 is a front view of a textured glove in accordance with an embodiment of the present invention.
Figure 3:
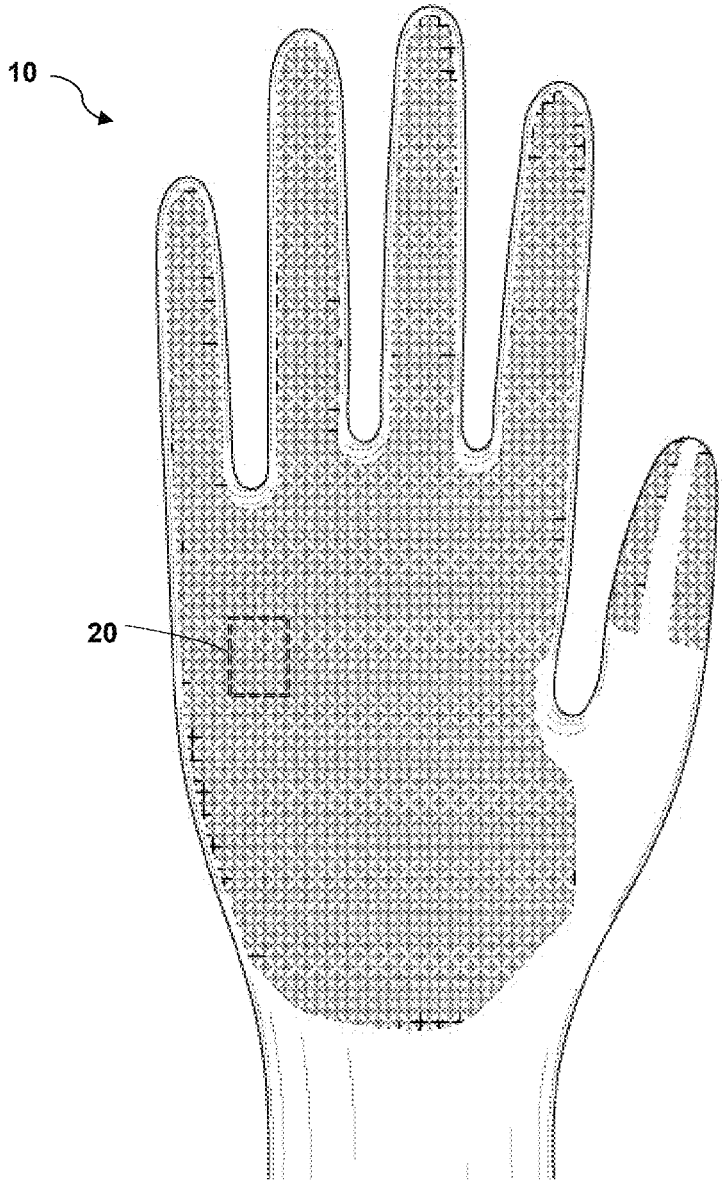
FIG. 3 is a back view of a textured glove in accordance with an embodiment of the present invention.

FIGS. 1 to 3 respectively show an isometric view, a front view and a back view of the elastomeric glove (10) with the texture pattern in accordance with an embodiment of the present invention. The elastomeric glove (10) comprises a superimposed texture provided on a surface of the elastomeric glove (10), including front and back of a palm region, a thumb region and fingers region. The superimposed texture applied to both the front and back surfaces allows the elastomeric glove (10) to be ambidextrous.

In accordance with an embodiment of the present invention, the fingers region includes an index finger, a middle finger, a ring finger, and a little finger with the superimposed texture extending from the palm region to the fingers region. However, unlike the fingers region, the superimposed texture does not extend from the palm region all the way to the thumb region. This creates a non-superimposed-textured portion between the palm region and the thumb region. More particularly, the thumb's upper region is covered with the superimposed texture, whereas the lower region is not covered with the superimposed texture, wherein the covered region is divided into left and right textured regions. The left and right textured regions encompass the front and back surfaces of the elastomeric glove (10), which includes both sides of the thumb region that face towards and away from the four fingers. Between the left and right textured region, there is a central region that remains texture-free. This design takes into account the user's thumb comfort and greater stability in gripping objects allowing greater indexing with textured contact surfaces at the thumb. Such indexing has not been a feature of any prior arts and creates a further unique aspect of this invention.

Figure 4:
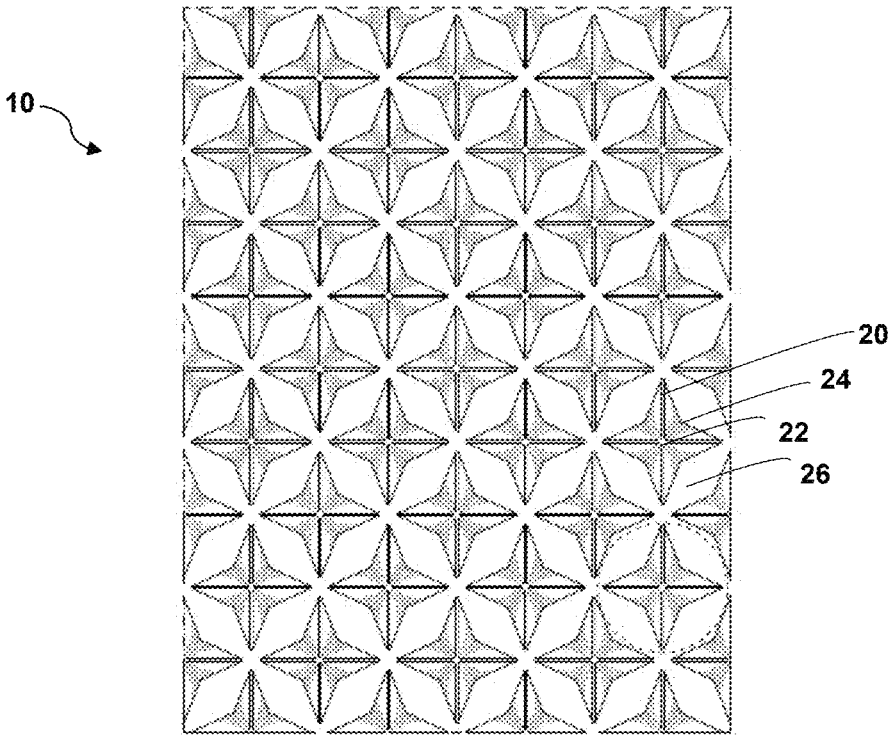
FIG. 4 is an enlarged view of a textured glove's outer surface in accordance with an embodiment of the present invention.
Figure 5:
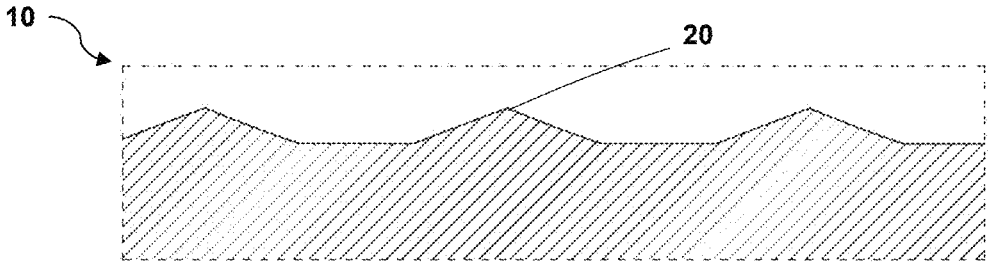
FIG. 5 is a cross-sectional view of multiple units of a stellate convex polygon distributed on the outer surface of the textured glove in accordance with an embodiment of the present invention.

FIG. 4 shows an enlarged view of the superimposed texture that is provided on the outer surface of the elastomeric glove (10). The superimposed texture comprises multiple units of a stellate convex polygon (20) distributed on the surface of the elastomeric glove (10). More preferably, the stellate convex polygon is a convex four-pointed stellate shape distributed evenly on the surface of the elastomeric glove (10). The stellate convex polygon (20) extended outwardly from the surface of the elastomeric glove (10) forming a tip (22) at the center for adding friction to the grasp surface of the elastomeric glove (10), thereby enhancing gripping performance in wet and dry conditions. Further, the stellate convex polygon (20) is folded at intersects (24) of the polygon (20) for diverting fluid away from the elastomeric glove (10) in wet condition. When multiple units of the stellate convex polygon (20) are distributed on the surface of the elastomeric glove (10), channels (26) are formed between the stellate convex polygons (20) for channelling fluid away from the elastomeric glove (10). More preferably, the channels (26) are formed continuously to allow fluid to be orderly diverted and channelled away from the outer surface of the elastomeric glove (10). The fluid diverting and channelling features reduce wetness, including but is not limited to water, oils, blood and chemicals, from surface of the elastomeric glove (10) to maintain the grip performance. FIG. 5 shows a cross-sectional view of the multiple units of the stellate convex polygon (20) distributed on the surface of the elastomeric glove (10).

Figure 6:
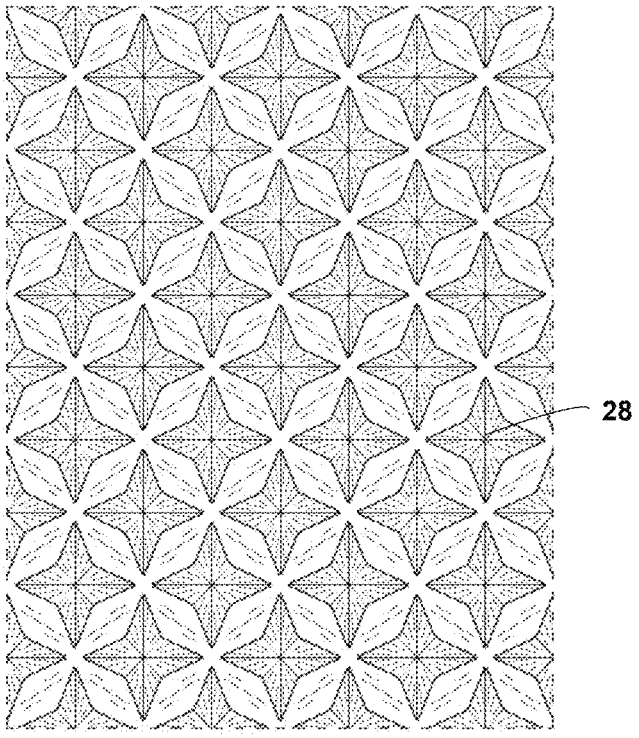
FIG. 6 is an enlarged view of a textured glove's inner surface in accordance with an embodiment of the present invention.

In accordance with an embodiment of the present invention, the multiple units of the stellate convex polygon (20) are distributed on the outer surface of the elastomeric glove (10), wherein the stellate convex polygon (20) comprises a protruding textured pattern that corresponds to a depressed textured pattern on an inner surface of the elastomeric glove (10). As shown in FIG. 6, the depressed textured pattern forms indentations (28) on the inner surface that help to retain and trap sweat. Notably, the channels (26) formed on the outer surface are not present on the inner surface of the elastomeric glove (10) since the textured pattern on the inner surface is the reverse of the textured pattern on the outer surface. More specifically, the channels (26) on the outer surface have a concave-shaped, whereas there are no channels on the inner surface, since the channels (26) on the outer surface are convex on the inner surface.

Figure 7:
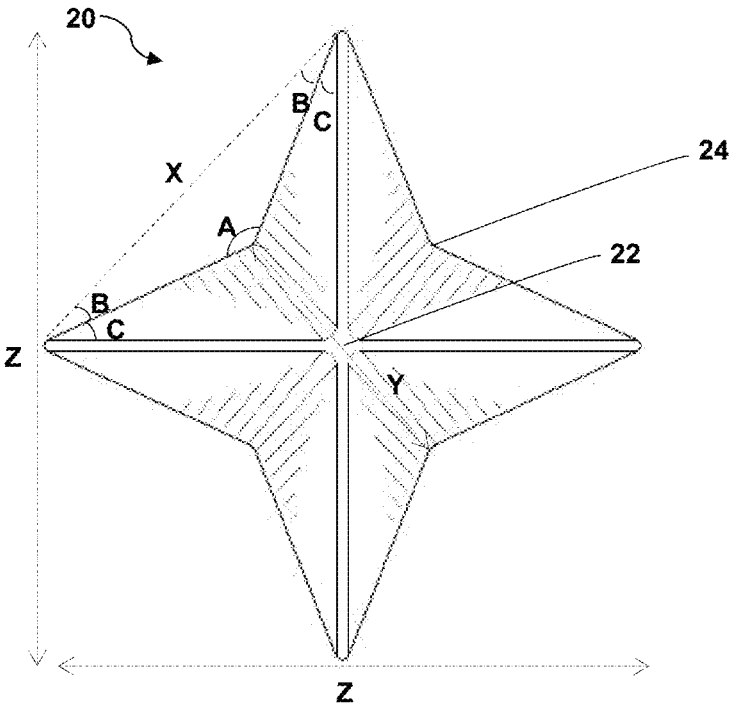
FIG. 7 is a single unit of a stellate convex polygon of the textured glove in accordance with an embodiment of the present invention.

FIG. 7 shows a single unit of the stellate convex polygon (20) in accordance with an embodiment of the present invention. The stellate convex polygon (20) comprises a unique geometry for grip enhancement. The following dimensions and angles are measured using 3D metrology scanning technique. According to a preferred embodiment of the present invention, the width of the area between the two adjacent corner vertices of the stellate convex polygon (20) shown by line "X" is in a range of 2.80 to 3.20 mm, more preferably, 2.90 to 3.10 mm. The width of the area between the two intersects (24) of the stellate convex polygon (20) shown by line "Y" is in a range of 2.00 to 2.40 mm, more preferably, 2.10 to 2.30 mm. The width of the area between the two opposite corner vertices of the stellate convex polygon (20) shown by line "Z" is in a range of 4.10 to 4.40 mm, more preferably, 4.20 to 4.30 mm. The height of the tip (22) from the flat surface of the elastomeric glove (10) is in a range of 0.60 to 0.80 mm, more preferably, 0.70 to 0.77 mm. The distance between side to side of two adjacent stellate convex polygons (20) in a horizontal row or top to bottom of two adjacent stellate convex polygons (20) in a vertical column is in a range of 1.20 to 1.40 mm, more preferably, 1.30 to 1.34 mm. An isosceles triangle with two equal sides and two equal angles is formed between the two adjacent corner vertices of the stellate convex polygon (20). The inward vertices with corresponding exterior angle shown by "A" is 138 to 146 degree, more preferably, 140 to 144 degree, and the angle shown by "B" is 17° to 21°, more preferably, 18° to 20° at both sides. The angle shown by "C" is 23 to 26 degree, more preferably, 24 to 25 degree. The interior angle of the outward-facing corner vertices is therefore 46 to 52 degree. When a frictional force is applied from any directions, the respective angles of the stellate convex polygon (20) may be widen due to the frictional force, and it will increase the friction resulting in tight contact between the sides of the stellate convex polygon (20) and the surface of the gripping object. Indeed, the eight slopes of the stellate design will increase the surface area of the gripping surface thus enhancing the coefficient of friction. By increasing the contact surface and enhancing its ability to conform with the object, this will result in vacuum formation and even further improve the grip.

Figure 8:
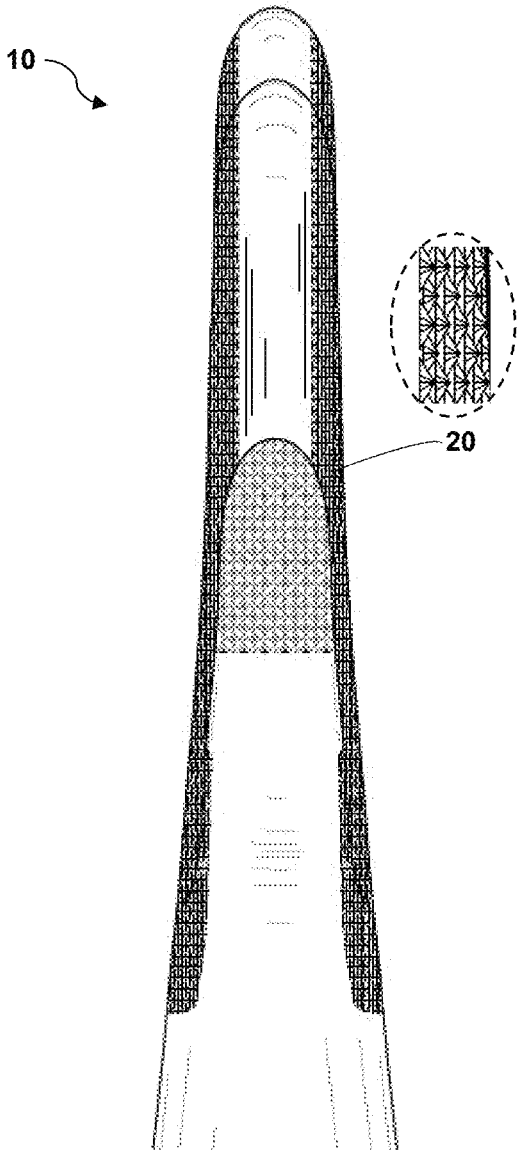
FIG. 8 is a left-side view of a textured glove in accordance with an embodiment of the present invention.
Figure 9:
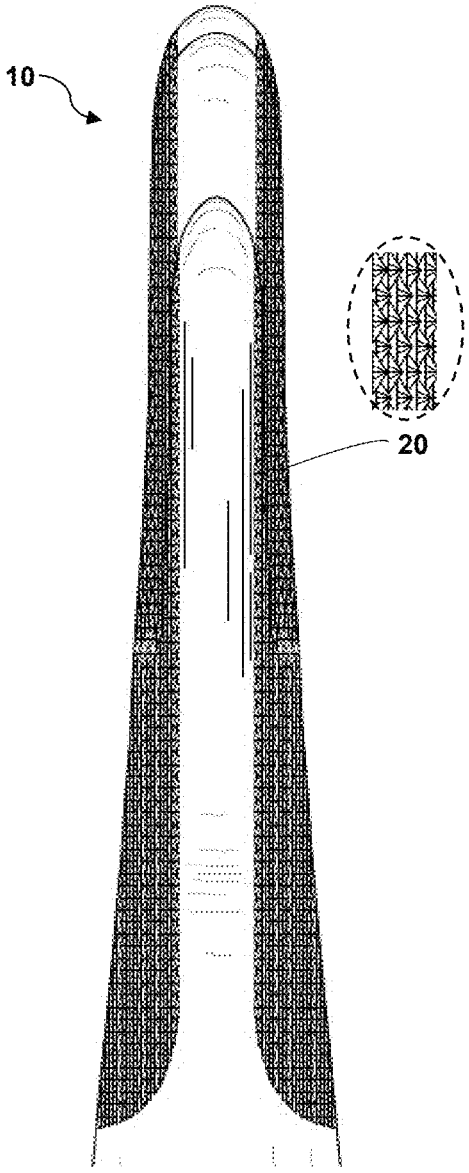
FIG. 9 is right-side view of a textured glove in accordance with an embodiment of the present invention.
Figure 10:
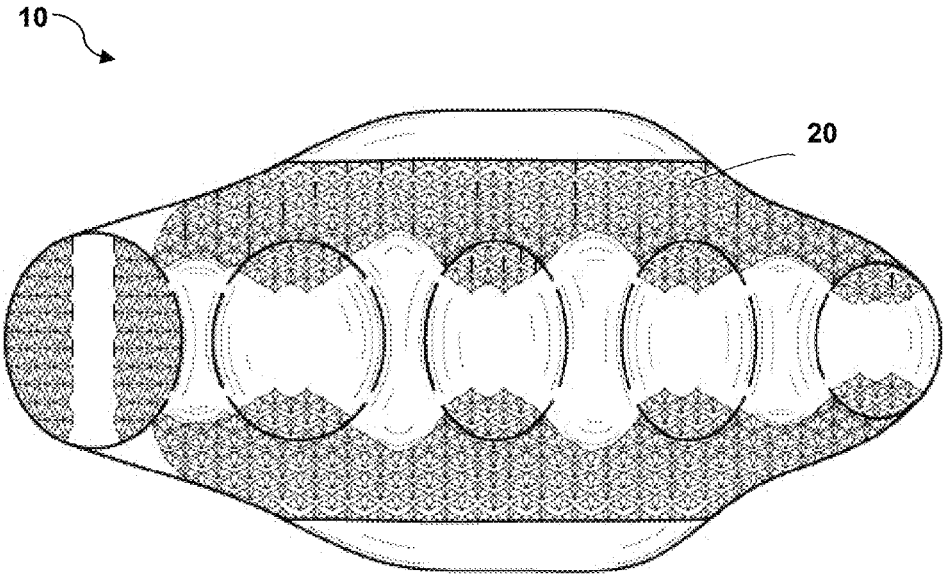
FIG. 10 is a top view of a textured glove in accordance with an embodiment of the present invention.

In accordance with an embodiment of the present invention, the elastomeric glove (10) comprises a non-superimposed-textured portion on the central region of the thumb tip, finger tips region, a region between the thumb and the index finger, a region between each of the four fingers, and a region that the little finger facing away from the four fingers, wherein the region between the thumb and the index finger, and the region between each of the four fingers include finger crotches region. The non-superimposed-textured portion can be clearly observed from FIGS. 8 to 10. FIG. 8 is a left-side view showing the non-superimposed-textured portion on the lower region of the thumb that faces away from the four fingers, the regions between the thumb and the index finger, and the index finger and the middle finger. FIG. 9 is a right-side view showing the non-superimposed-textured portion on the region that the little finger facing away from the four fingers, the regions between the little finger and the ring finger, and the ring finger and the middle finger. FIG. 10 is a top view showing the non-superimposed-textured portion on the central region of the thumb tip, the finger tips region and the finger crotches region of the elastomeric glove (10).

The present invention also proposes a synthetic latex formulation to produce the elastomeric glove (10), which is soft and durable.

In accordance with an embodiment of the present invention, the latex formulation comprises a combination of a base polymer, pH adjuster, crosslinker, vulcanizing agent, accelerator, antifoam, opacity enhancer and pigment.

In accordance with an embodiment of the present invention, the base polymer comprises acrylonitrile butadiene rubber latex, polyisoprene latex, styrene butadiene rubber latex, polychloroprene latex, polyurethane rubber or any combination thereof. More preferably, the base polymer is acrylonitrile butadiene rubber latex in an amount of 100.0 phr. The acrylonitrile butadiene rubber latex contains hydrophilic carboxylic acid groups which can assist in absorbing sweat generated by hands during work operation.

In accordance with an embodiment of the present invention, the pH adjuster comprises potassium hydroxide, zinc oxide, magnesium oxide, aluminum oxide or any combination thereof in a range of 0.50 to 1.80 phr to adjust the pH within a range of 10 to 11.5. More preferably, the pH adjuster is potassium hydroxide in an amount of 1.0 phr.

In accordance with an embodiment of the present invention, the crosslinker is preferably but not limited to zinc oxide in a range of 0.60 to 2.0 phr. More preferably, zinc oxide is in an amount of 1.10 phr.

In accordance with an embodiment of the present invention, the vulcanizing agent is preferably but not limited to sulphur in a range of 0.40 to 1.40 phr. More preferably, sulphur is in an amount of 0.80 phr.

In accordance with an embodiment of the present invention, the accelerator comprises thiazoles, guanidines, amines, thioureas, dithiocarbamates, xanthates, thiurams, sulfonamides or any combination thereof in an amount of 0.40 to 1.40 phr. More preferably, the accelerator is zinc diethyl dithiocarbamate in an amount of 0.80 phr.

In accordance with an embodiment of the present invention, the antifoam is water-based antifoams in a range of 0.01 to 0.04 phr. More preferably, the water-based antifoam is in an amount of 0.02 phr.

In accordance with an embodiment of the present invention, the opacity enhancer is preferably but not limited to titanium oxide in a range of 1.50 to 5.40 phr. More preferably, titanium oxide is in an amount of 3.45 phr.

In accordance with an embodiment of the present invention, the pigment is in a range of 0.20 to 0.50 phr. More preferably, the pigment is in an amount of 0.35 phr.

In accordance with an embodiment of the present invention, the latex formulation may further comprise surfactants, dispersants, clays, waxes, antioxidants, fillers, viscosity modifiers, rheology modifiers, functional additives or any combination thereof. The fillers are preferably but not limited to calcium carbonate, aluminum silicate or a combination thereof.

In accordance with an embodiment of the present invention, the elastomeric glove (10) is produced by single-dipping or double-dipping. In the single-dipping process, a glove former is dipped into the above-mentioned synthetic latex formulation to coat a first latex layer on the glove former. In the double-dipping process, the glove former with the first latex layer is dipped into the same synthetic latex formulation again to coat a second latex layer on top of the first latex layer. The second latex layer may be chlorinated and/or treated with an additional polymer coating to enhance the user experience, making it easier to don the elastomeric glove (10) in both dry and wet conditions or to apply a skin-beneficial agent to the user's skin. Further, chlorination will roughen the surface of the elastomeric glove (10) which further enhances sweat absorption. The second latex layer is coated on the outer surface which when the elastomeric glove (10) is removed from the manufacturing line, the elastomeric glove (10) will be reversed and so becomes the inner surface of the elastomeric glove (10). Meanwhile, the first latex layer is coated on the inner surface which when the elastomeric glove (10) is removed from the manufacturing line, the elastomeric glove (10) will be reversed and so becomes the outer surface of the elastomeric glove (10). The above-mentioned formulation synergizes with the stellate convex polygon (20) texture to produce the elastomeric glove (10) with malleable and pliable properties. In other words, the soft and durable elastomeric glove (10) can be easily bent or changed shape according to the gripping object without breaking or cracking. This is because the material of the elastomeric glove (10) itself provides a certain level of suction to supplement the grip. Therefore, the elastomeric glove (10) of the present invention is capable of providing a comfortable wearing experience to the user while allowing the user nimbly and firmly handle the object.

The present invention further proposes the glove former for producing the elastomeric glove (10) with the stellate convex polygon (20) texture. More particularly, the surface of the glove former is debossed with multiple units of the stellate convex polygon (20). When the glove former is dipped into the synthetic latex formulation, the latex layer facing the glove former will be imparted with the protruding textured pattern of the stellate convex polygon (20), while the latex layer facing away from the glove former will receive the corresponding depressed textured pattern. When the elastomeric glove (10) is stripped from the glove former and reversed, the latex layer with the protruding textured pattern becomes the outer surface of the elastomeric glove (10), and the latex layer with the depressed textured pattern becomes the inner surface of the elastomeric glove (10).

Hereinafter, an example of the present invention will be provided for more detailed explanation. The advantages of the present invention may be more readily understood and put into practical effect from this example. However, it is also to be understood that the following example is not to limit the scope of the present invention in any way.

EXAMPLES

Example 1—Latex Formulation

Table 1 shows the latex formulation for producing the elastomeric glove (10) with the first latex layer, which forms as the outer and inner surfaces of the elastomeric glove (10), for gripping objects.

TABLE 1

Latex formulation

| Chemical components | Amount (phr) |
|---|---|
| Acrylonitrile butadiene rubber latex | 100 |
| Potassium hydroxide | 1.00 |
| Zinc oxide | 1.10 |
| Sulfur | 0.80 |
| Zinc diethyl dithiocarbamate | 0.75 |
| Antifoam | 0.02 |
| Titanium oxide | 3.45 |
| Pigment | 0.35 |

Example 2—Friction Test

The coefficient of friction tests were conducted in dry and wet conditions to compare the static and dynamic friction loads of the elastomeric glove (10) with the stellate convex polygon (20) of the present invention and the conventional textured gloves with different patterns including the fish-scale pattern and diamond pattern. The tests were conducted according to ASTM D1894 standard requirement. The results of the tests are presented in the following tables.

TABLE 2

Results of the coefficient of friction test in dry and wet conditions

| Type of glove | Condition | Sample no. | Static friction load (μs) | Dynamic friction load (μk) |
|---|---|---|---|---|
| Elastomeric glove (10) with the stellate convex polygon (20) of the present invention | Dry | 1 | 0.201 | 0.181 |
| | | 2 | 0.212 | 0.184 |
| | | 3 | 0.203 | 0.177 |
| | Average | | 0.205 | 0.181 |
| | Wet | 1 | 0.235 | 0.213 |
| | | 2 | 0.264 | 0.235 |
| | | 3 | 0.234 | 0.234 |
| | Average | | 0.244 | 0.227 |
| Conventional textured glove A (fishscale pattern) | Dry | 1 | 0.170 | 0.131 |
| | | 2 | 0.173 | 0.137 |
| | | 3 | 0.165 | 0.145 |
| | Average | | 0.169 | 0.138 |

TABLE 2-continued

Results of the coefficient of friction test in dry and wet conditions

| Type of glove | Condition | Sample no. | Static friction load (μs) | Dynamic friction load (μk) |
|---|---|---|---|---|
| | Wet | 1 | 0.204 | 0.202 |
| | | 2 | 0.223 | 0.208 |
| | | 3 | 0.245 | 0.209 |
| | Average | | 0.224 | 0.206 |
| Conventional textured glove B (diamond pattern) | Dry | 1 | 0.173 | 0.153 |
| | | 2 | 0.187 | 0.166 |
| | | 3 | 0.195 | 0.175 |
| | Average | | 0.185 | 0.165 |
| | Wet | 1 | 0.241 | 0.223 |
| | | 2 | 0.244 | 0.221 |
| | | 3 | 0.225 | 0.202 |
| | Average | | 0.237 | 0.215 |

According to the result in Table 2, the elastomeric glove (10) with the stellate convex polygon (20) of the present invention showed 21% increase in static friction and 31% increase in dynamic friction compared to the conventional textured glove A (fishscale pattern) in dry condition. The stellate convex polygon (20) of the present invention showed 11% and 10% increase in static friction and dynamic friction respectively compared to the conventional textured glove B (diamond pattern) in dry condition.

In wet condition, the elastomeric glove (10) with the stellate convex polygon (20) of the present invention showed 9% increase in static friction and 10% increase in dynamic friction compared to the conventional textured glove B (diamond pattern): The elastomeric glove (10) with the stellate convex polygon (20) of the present invention showed 3% increase in static friction and 6% increase in dynamic friction compared to the conventional textured glove B (diamond pattern) in wet condition.

Example 3—Torque Test

The gripping performance of the gloves was evaluated using a torque meter, following the ASTM F2961-22 standard requirements. Quantitative measurements were taken of individuals wearing gloves while gripping and twisting a smooth cylindrical rod attached to a torque meter. The test subjects performed the task with bare hands, the gloves of the present invention, and conventional gloves, each for five repetitions. The maximum torque readings from the torque meter were recorded for each set of five repetitions. The bare-handed control value is calculated as follows:

$$\%\ BHCV = TG/TB \times 100\%$$

where

% BHCV=percentage of bare-handed control value

TG=average maximum torque applied with gloved hand

TB=average maximum torque applied with bare hand

This test data was collected from 24 test subjects from in-house population which covers 80% male, 20% female. The results are presented in Table 3 below.

TABLE 3

Results of the bare-handed control value (BHCV) of different gloves

| | Present invention | Conventional textured glove A (fishscale) | Conventional textured glove B (diamond) |
|---|---|---|---|
| BHCV % | 174.14 | 133.14 | 120.00 |

As can be seen from the tests data, the gloves of the present invention showed highest bare-handed control value (BHCV %) as compared to conventional textured gloves (fishscale and diamond patterns), indicating that the gloves of the present invention have better gripping performance as compared to the conventional texture gloves.

Example 4—Pinch Grip Tests

The gloves were tested according to the SATRA TM437: 2011 standard, which involves a subjective assessment of grip and control during various actions. Tests were conducted under three conditions: dry, wetted with water, and wetted with a 5% washing detergent solution. The glove performance was evaluated by assigning a score from 0 to 4 for each of total 6 questions in accordance with Table 4A below. The tests were conducted in triplicates, and the summed scores for each condition are presented in Table 4B.

TABLE 4A

Key responses and scoring for the glove performance

| Question | Glove performance score | | | |
|---|---|---|---|---|
| 1. Did you find the action of gripping the grip bar and pulling it down: | Very easy Score 4 | Easy Score 3 | Difficult Score 2 | Very difficult Score 0 |
| 2. Was your control during this action: | Excellent Score 4 | Good Score 3 | Poor Score 2 | No control Score 0 |
| 3. Did you find the action of allowing the grip bar to slip through your finger and thumb: | Very easy Score 4 | Easy Score 3 | Difficult Score 2 | Very difficult Score 0 |
| 4. Was your control during this action: | Excellent Score 4 | Good Score 3 | Poor Score 2 | No control Score 0 |
| 5. Did you find the action of catching the grip bar: | Very easy Score 4 | Easy Score 3 | Difficult Score 2 | Very difficult Score 0 |
| 6. Was your control during this action: | Excellent Score 4 | Good Score 3 | Poor Score 2 | No control Score 0 |

TABLE 4B

Mean subjective test scores

| Conditions | Load (kg) | Present invention | Conventional textured glove A (fishscale pattern) | Conventional textured glove B (diamond pattern) |
|---|---|---|---|---|
| Wetted with water | 1.5 | 24 | 20 | 21 |
| | 1.0 | — | — | — |
| | 0.5 | — | — | — |
| Wetted with 5% solution of washing detergent in water | 1.5 | 24 | 19 | 19 |
| | 1.0 | — | — | — |
| | 0.5 | — | — | — |

It can be seen from the test results that the subjective scores of the invention received highest mean score compared to other type of gloves, which suggested that the grip and dexterity of the gloves of the present invention is superior compared to other conventional textured gloves.

The results above indicate that the texture pattern and the latex formulation proposed in the present invention are feasible for enhancing gripping properties of the elastomeric glove (10).

Various modifications to these embodiments are apparent to those skilled in the art from the description and the accompanying drawings. The principles associated with the various embodiments described herein may be applied to other embodiments. Therefore, the description is not intended to be limited to the embodiments described shown along with the accompanying drawings but is to provide broadest scope of consistent with the principles and the novel and inventive features disclosed or suggested herein. Accordingly, the invention is anticipated to hold on to all other such alternatives, modifications, and variations that fall within the scope of the present invention and appended claim.

The invention claimed is:

1. An elastomeric glove, comprising:

a superimposed texture provided on a surface of the elastomeric glove, including front and back of a palm region, a thumb region and fingers region, wherein the superimposed texture comprises multiple units of a stellate convex polygon distributed on the surface of the elastomeric glove, with a tip at the center and folded at intersects of the polygon for gripping, diverting and channelling fluid away from the surface of the elastomeric glove, and wherein the stellate convex polygon comprises a plurality of outward-facing corner vertices and plurality of inward-facing vertices, with equal sides connecting each of the plurality of outward-facing corner vertices to adjacent inward-facing vertices, wherein each of the plurality of inward-facing vertices has an exterior angle of 138 to 146 degrees, and each of the plurality of outward-facing corner vertices has an interior angle of 46 to 52 degrees.

2. The elastomeric glove as claimed in claim 1, wherein a non-superimposed texture portion is provided on a region between the palm region and the thumb region.

3. The elastomeric glove as claimed in claim 1, wherein the superimposed texture provided on the thumb region is divided into a left texture region and a right texture region, encompassing a front surface and a back surface of the elastomeric glove.

4. The elastomeric glove as claimed in claim 3, wherein the left texture region and the right texture region are separated by a central region with a non-superimposed texture portion.

5. The elastomeric glove as claimed in claim 1, wherein the stellate convex polygon is a four-pointed stellate shape.

6. The elastomeric glove as claimed in claim 1, wherein channels are formed between the multiple units of the stellate convex polygon.

7. The elastomeric glove as claimed in claim 1, wherein the stellate convex polygon comprises a protruding textured pattern that corresponds to a depressed textured pattern on an inner surface of the elastomeric glove.

8. The elastomeric glove as claimed in claim 1, wherein a non-superimposed textured portion is provided on a central region of a thumb tip, a finger tips region, a region between a thumb and an index finger, a region between each of four fingers, and a region that a little finger facing away from the four fingers.

* * * * *